US005130180A

United States Patent [19]

Koshizuka et al.

[11] Patent Number: 5,130,180

[45] Date of Patent: * Jul. 14, 1992

[54] THERMAL TRANSFER RECORDING MEDIUM CAPABLE OF MULTIPLE PRINTING

[75] Inventors: Kunihiro Koshizuka; Tatsuichi Maehashi; Takao Abe, all of Tokyo, Japan

[73] Assignee: Konica Corporation, Tokyo, Japan

[ * ] Notice: The portion of the term of this patent subsequent to Feb. 26, 2008 has been disclaimed.

[21] Appl. No.: 479,267

[22] Filed: Feb. 13, 1990

[30] Foreign Application Priority Data

Feb. 15, 1989 [JP] Japan ..... 1-36469
Feb. 15, 1989 [JP] Japan ..... 1-36470
Feb. 17, 1989 [JP] Japan ..... 1-37880

[51] Int. Cl.[5] ..... B41M 5/26

[52] U.S. Cl. ..... 428/212; 428/195; 428/484; 428/488.4; 428/913; 428/914

[58] Field of Search ..... 428/195, 336, 423.1, 428/474.4, 480, 484, 488.1, 913, 914, 212, 488.4

[56] References Cited

U.S. PATENT DOCUMENTS 4,960,632 10/1990 Tohma et al. ..... 428/488.4
4,996,093 2/1991 Koshizuka et al. ..... 428/488.4

*Primary Examiner*—Pamela R. Schwartz
*Attorney, Agent, or Firm*—Finnegan, Henderson, Farabow, Garrett and Duner

[57] ABSTRACT

The improved thermal transfer recording medium capable of multiple printing has at least two heat-fusible colorant layers formed in superposition on a support and a heat-fusible colorless layer is provided between the heat-fusible colorant layers. This recording medium is capable of producing a sharp, ghost-free image through many cycles of printing operation.

5 Claims, 5 Drawing Sheets

THERMAL TRANSFER RECORDING MEDIUM CAPABLE OF MULTIPLE PRINTING

BACKGROUND OF THE INVENTION

The present invention relates to a thermal transfer recording medium capable of multiple printing (which is hereinafter sometimes referred to simply as a "thermal transfer recording medium"). More particularly, the present invention relates to a thermal transfer recording medium that is capable of providing a sharp, ghost-free image through many cycles of printing operation.

Various versions of thermal transfer recording media capable of multiple printing have heretofore been reported and they include: a thermal transfer recording medium of a "cohesive failure" type that comprises a comparatively thick, single ink layer formed on a support with a resin layer interposed, and which performs multiple printing with only a part of the ink layer being used for each cycle of transfer [see JP-A-57-36698 (the term "JP-A" as used herein means an "unexamined published Japanese patent application")]; a thermal transfer recording medium of an "exudation" type that uses an ink layer having a heat-fusible ink in a high-molecular weight porous material and which performs multiple printing with the heat-fusible ink exudating in small portions from the porous material (see JP-A-54-68235); and a thermal transfer recording medium of a "fence" type that uses an ink layer having a fine particulate filler and a heat-fusible ink and which performs multiple printing with the amount of ink transfer per impression being controlled by the fine particulate filter (see JP-A-57-160691). These prior art thermal transfer recording media, however, have had the disadvantage that in second and subsequent impressions, "ghost" characterized by uneven densities in image areas, interruption of characters and other phenomena due to previous impressions occurs on the surface of prints.

It is not completely clear why "ghost" occurs but according to the studies conducted by the present inventor, the following explanation may be postulated: in a thermal transfer recording medium of a "cohesive failure" type, the ink layer has fine asperities formed on the surface following the first impression and these asperities create unevenness in platen pressure in the next impression, thereby causing "ghost". The ghost occurring in thermal transfer recording media of "exudation" and "fence" types could be explained in the same way.

Another problem with the prior art thermal transfer recording media designed for multiple printing is that the ink layer is so susceptible to temperature changes that if they are used in a hot environment, an increased amount of ink will be transferred per impression, thus reducing the number of printing cycles that can be accomplished with the medium. If, on the other hand, the medium is used in a cold environment, the amount of ink transfer per impression will decrease to produce very low densities in prints.

SUMMARY OF THE INVENTION

The present invention has been accomplished under the circumstances described above and its principal object is to provide a thermal transfer recording medium that is capable of producing a sharp and ghost-free image through many cycles of printing operation, that is capable of as many impressions as desired to produce consistent densities in printed image without being influenced by temperature changes, and that yet is capable of producing high-density image.

The thermal transfer recording medium of the present invention has at least two heat-fusible colorant layers formed in superposition on a support and is characterized by having a heat-fusible colorless layer between said heat-fusible colorant layers.

DETAILED DESCRIPTION OF THE INVENTION

Figure 1:
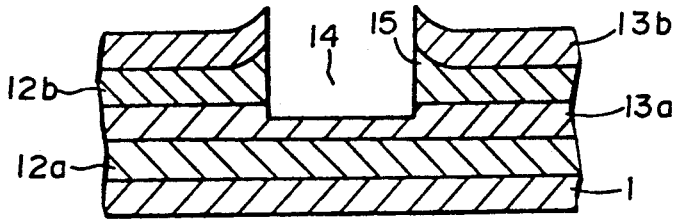
FIG. 1 is a cross-sectional sketch of a thermal transfer recording medium that has heat-fusible colorant layers transferred partly to create a deficient area.

The thermal transfer recording medium of the present invention comprises a support that has at least two heat-fusible colorant layers and a heat-fusible colorless layer held between said colorant layers.

The components of the thermal transfer recording medium of the present invention are described hereinafter in the order of the support, heat-fusible colorant layers and the heat-fusible colorless layer.

SUPPORT

The support used in the thermal transfer recording medium of the present invention desirably has high heat resistance and good dimensional stability. The support may be made of various materials selected from the following: paper substrates such as plain paper, capacitor paper, laminated paper and coated paper; resin films such as polyethylene, polyethylene terephthalate, polysulfone, polystyrene, polypropylene and polyimide; composites of paper and resin films; and metal sheets such as an aluminum foil. Any of these materials may be used with advantage.

The support generally has a thickness of no more than 30 μm, with the range of 2–30 μm being preferred. If the thickness of the support exceeds 30 pm, heat conductivity decreases, causing occasional deterioration of the print quality.

The back side of the support may have any layer arrangement and if desired, it may be provided with a backing layer such as an anti-sticking layer.

The thermal transfer recording medium of the present invention may have heat-fusible colorant layers to be described hereinafter that are formed in direct contact with the support, or with an adhesive layer interposed. An adhesive layer, if provided, helps enhance the adhesion between the support and the heat-fusible colorant layers. The adhesive layer may be formed of such materials as a polyester resin, a polyamide resin, polyvinyl acetate, an ethylene/vinyl acetate copolymer, and an ethylene/ethyl acrylate copolymer. The adhesive layer may be formed on the support by various methods such as hot-melt coating, aqueous coating, or a coating method using organic solvents. The adhesive layer preferably has a thickness in the range of 0.1–3.0 μm.

HEAT-FUSIBLE COLORANT LAYERS

The heat-fusible colorant layers to be used in the present invention contain a colorant and a heat-fusible material as basic ingredients. Illustrative colorants include pigments, both inorganic and organic, and dyes. Exemplary inorganic pigments include titanium dioxide, carbon black, zinc oxide, Prussian Blue, cadmium sulfide, iron oxide, as well as chromates of lead, zinc, barium and calcium. Exemplary organic pigments include pigments such as azo, thioindigoid, anthraquinone, anthanthrone and triphene dioxazine compounds, vat pigments, phthalocyanine dyes such as copper phthalocyanine, derivatives thereof, and quinacridone pigments. Exemplary dyes include acid dyes, direct dyes, disperse dyes, oil-soluble dyes, and metal-containing oil-soluble dyes.

The heat-fusible colorant layers contain these colorants in amounts ranging from 5 to 35 wt %, preferably from 10 to 25 wt %.

Specific examples of the heat-fusible materials that can be used include: vegetable waxes such as carnauba wax, Japan wax, ouricury wax and esparto wax; insect and animal waxes such as beeswax, shellac and spermaceti wax; petroleum waxes such as paraffin wax, microcyrstalline wax, polyethylene wax, ester waxes and acid waxes; and mineral waxes such as montan wax, ozokerite and ceresin. Other heat-fusible materials that can be used include: higher aliphatic acids such as palmitic acid, stearic acid, margaric acid and behenic acid; higher alcohols such as palmityl alcohol, stearyl alcohol, behenyl alcohol, margaryl alcohol, myricyl alcohol and eicosanol; higher aliphatic acid esters such as cetyl palmitate, myricyl palmitate, cetyl stearate and myricyl stearate; amides such as acetamide, propionic acid amide, palmitic acid amide, stearic acid amide and amide wax; and higher amines such as stearylamine, behenylamine and palmitylamine. These heat-fusible materials may be used either independently or as admixtures.

The heat-fusible colorant layers contain these heat-fusible materials in amounts that usually range from 10 to 95 wt %, preferably from 30 to 80 wt %.

The heat-fusible colorant layers in the thermal transfer recording medium of the present invention may contain a thermoplastic resin to the extent that will not impair the objects of the present invention. Illustrative thermoplastic resins that can be used include: resins such as ethylenic copolymers, polyamide resins, polyester resins, polyurethane resins, polyolefinic resins, acrylic resins, vinyl chloride resins, cellulosic resins, rosin resins, ionomer resins and petroleum resins; elastomers such as natural rubber, styrene/butadiene rubber, isoprene rubber, chloroprene rubber and diene containing copolymers; rosin derivatives such as ester gum, rosin/maleic acid resin, rosin/phenolic resin and hydrogenated rosin; and high-molecular weight compounds having a softening point of 50°–150° C. such as phenolic resins, terpene resins, cyclopentadiene resins and aromatic hydrocarbon resins. These thermoplastic resins may be used either on their own or as admixtures.

The heat-fusible colorant layers contain these thermoplastic resins in amounts that usually range from 2 to 50 wt %, preferably from 5 to 30 Wt %.

The heat-fusible colorant layers may contain additives such as inorganic or organic fine particles (e.g. metal powders and silica gel) or oils (e.g. linseed oil and mineral oils) to the extent that will not impair the objects of the present invention.

The heat-fusible colorant layers can be formed by various coating methods such as hot-melt coating, aqueous coating and a coating method that employs organic solvents.

The heat-fusible colorant layers preferably have a thickness in the range of 0.5–5 μm.

Each of the heat-fusible colorant layers may be single-layered or it may be composed of more than one layer to the extent that will not impair the objects of the present invention.

HEAT-FUSIBLE COLORLESS LAYER

The heat-fusible colorless layer to be used in the present invention contain a heat-fusible material as a basic ingredient. Heat-fusible materials that are the same as those employed in the heat-fusible colorant layers described above are preferably used in the heat-fusible colorless layer.

Besides the heat-fusible material described above, the heat-fusible colorless layer may contain no more than 10 wt % of a colorant but the thermal transfer recording medium of the present invention preferably uses a colorless heat-fusible layer that is substantially free of colorants and that has a light transmittance of at least 80%.

The colorants that may optionally be used in the heat-fusible colorless layer are advantageously the same as those employed in the heat-fusible colorant layers.

What is important to the thermal transfer recording medium of the present invention is that in successive impressions, separation by cohesive failure or interfacial failure be realized only at the heat-fusible colorless layer held between heat-fusible colorant layers, to thereby prevent separation at these heat-fusible colorant layers. It is therefore necessary that the cohesive force of the heat-fusible colorless layer held between heat-fusible colorant layers be smaller than that of any of the heat-fusible colorant layers adjacent to said heat-fusible colorless layer in order to insure that separation by cohesive failure or interfacial failure will occur at said heat-fusible colorless layer. As will be described later in this specification, the same result can be attained by varying the melt viscosities of the individual layers.

Cohesive force can be adjusted by various methods such as (1) selecting heat-fusible materials that have different degrees of cohesive force, (2) varying the type and proportions of a heat-fusible material and a thermoplastic resin to be used, (3) incorporating inorganic or organic fine particles (e.g. metal powders and silica gel) or oils (e.g. linseed oil and mineral oils), and (4) incorporating suitable additives. These and other methods can be employed without particular limitation as long as the cohesive force of the heat-fusible colorless layer can be made smaller than that of the heat-fusible colorant layers.

If more than one heat-fusible colorless layer is to be held between heat-fusible colorant layers, the cohesive force of these colorless layers preferably increases as they are situated closer to the support. By so doing, the heat-fusible colorant layers can be transferred in such a way that the outermost layer is transferred first, then comes off the next top layer. Needless to say, even the heat-fusible colorless layer having the greatest cohesive force does not have as great cohesive force as adjacent heat-fusible colorant layers.

Additives that may be used to adjust cohesive force include polyoxyethylene compounds and polar waxes, with polyoxyethylene compounds being particularly preferred. In the presence of such additives, the cohesive force of the heat-fusible colorless layers is sufficiently reduced to realize separation by cohesive failure at those layers whereas enhanced adhesion is provided between each of these layers and adjacent heat-fusible colorant layer.

Any type of polyoxyethylene compound may be used as long as it has a portion represented by the following formula in its molecule:

$$-(CH_2CH_2O)_n-$$

(where n is an integer of at least 2, preferably 4–200). The polyoxyethlene compound may be terminated with —OH at both ends, or it may be in the form of derivatives. Illustrative derivatives of the polyoxyethylene compound are those which have an ether bond, an ester bond, a bond to sulfur or nitrogen atoms, a urethane bond or various other forms of bond, as obtained by reacting polyethylene glycol or one or two alcoholic hydroxyl groups in polyethylene glycol with various organic compounds.

Preferred polyoxyethylene compounds are those which have melting or softening points of 0°–120° C., with the range of 40°–100° C. being particularly preferred. The polyoxyethylene chain portion of the polyoxyethylene compound preferably has a molecular weight of 40–20,000, with the range of 200–9,000 being more preferred. The polyoxyethylene compound is incorporated in the heat-fusible colorless layer in an amount that usually ranges from 5 to 100 wt %, preferably from 5 to 50 wt %.

Polar waxes that may be used as additives for adjusting the cohesive force of heat-fusible colorless layers contain at least three polar bonds in the molecule, as selected from an ester bond (—CO—O—), an amide bond (—CONH—) and a urethane bond (—NH-COO—), and any such waxes can be used without particular limitation as long as the objects of the present invention will not be impaired.

The present inventor found that cohesive failure occurred consistently at the heat-fusible colorless layers when they contained a wax having at least three polar bonds in its molecule. Specific examples of the polar wax include polyester waxes, amide waxes and polyurethane waxes. Illustrative polyester waxes are those compounds which contain at least three ester bonds (—CO—O—) in their molecule and which have a weight average molecular weight (Mw) in the range of 300–12,000 and a melting point (m.p.) in the range of 30°–120° C. The ester bonds (—CO—O—) are contained in the backbone chain of the polyester. Such compounds can be obtained either as the polycondensation product of polyhydric alcohols and polybasic acids or as the ring-opening polymerization product of lactone compounds. Typical examples of the polyester wax are listed below:

(1) the polycondensation product of adipic acid and 1,4-butanediol (Mw=2,000; m.p. 55° C.);

(2) the ring-opening polymerization product of ε-caprolactone:

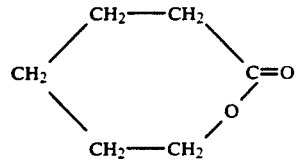

(Mw=4,000; m.p. 55° C.);

(3) sebacic acid/decamethylene glycol copolymer (Mw=3,000; m.p. 74° C.);

(4) adipic acid/propylene glycol copolymer (Mw=3,000; m.p. 50° C.);

(5) ω-hydroxydecanoic acid polymer (Mw=4,000; m.p. 75° C.); and (6) δ-valeroactone polymer (Mw=4,000; m.p. 54° C.).

Polyester waxes that can be used in the present invention may be those compounds which contain the above-described polyesters as blocks or grafts in the molecule, preferably terminated with an alkyl or amido group. They may also contain one or more of such groups as a hydroxyl group, an amino group, a carboxyl group or a carbonyl group. If desired, the polyester waxes may partly contain an ether bond, an amido bond or a urethane bond in either the backbone chain or side chains.

The polyesters that can be used in the present invention are in no way limited to those which are synthesized by reaction between the above described dibasic acids and dihydric alcohols or between the polybasic acids and polyhydric alcohols also described above. Polyester waxes synthesized by reaction between other dibasic acids and dihydric alcohols or between other polybasic acids and polyhydric alcohols may also be used. Polyester waxes can also be obtained as commercial products such as "Plakcel" series (trade name of Daicel Chemical Industries, Ltd.) and "Elitel" series (trade name of Unitika, Ltd.).

Illustrative amide waxes that can be used as polar waxes are those compounds which contain at least three amido bonds (—CO—NH—) in their molecule and which have a weight average molecular weight (Mw) in the range of 300–12,000 and a melting point (m.p.) in the range of 30°–120° C. The amide bonds (—CO—NH—) are contained in the backbone chain of the polyamide. Amide waxes can generally be obtained by the reaction of polymerization between dibasic acids and diamines, the auto-condensation reaction of ω-amino acids, and the ring-opening polymerization reaction of lactam compounds. It is particularly preferred that the polyamide portion of amide waxes is N-alkylated to have their melting point adjusted (say, reduced). N-alkylation can be accomplished by using N-alkyl or N,N'-dialkyldiamine in admixture with the diamine to be polymerized with a dibasic acid, or by using ω-alkylamino acid corresponding to ω-amino acid.

A specific example of polymers that can be used as a polyamide wax in the present invention is ω-N-methylaminoundecanoic acid polymer (Mw=ca. 5,000; m.p. 60° C.). Some polymers are commercially available as in HT-W series (product of Sanwa Kogyo K.K.).

Polyamide waxes that can be used in the present invention may be those compounds which contain the above-described polyamides as blocks or grafts in the molecule, preferably terminated with an alkyl or amido group. They may also contain one or more of such bonds as an ether bond, an amido bond or a urethane bond either in the backbone chain or side chains.

Illustrative polyurethane waxes that can be used as polar waxes in the present invention are those compounds which contain at least three urethane bonds (—NH—CO—O—) in their molecule and which have a weight average molecular weight (Mw) in the range of 300-12,000 and a melting point (m.p.) in the range of 30°-120° C. The urethane bonds (—NH—CO—O—) are contained in the backbone chain of the polyurethane. Polyurethane waxes can generally be obtained by the polyaddition reaction between diisocyanate and glycol but they can also be synthesized by various other methods such as condensation reaction. A specific example of polymers that can be used as a polyurethane wax in the present invention is the polycondensation product of hexamethylene diisocyanate and hexane-2,5-diol (Mw=ca. 1,200, m.p. 86° C.). If desired, the polyurethane waxes may partly contain an ether bond, an amido bond or a urethane bond in either the backbone chain or side chains.

The polyester waxes, polyamide waxes and polyurethane waxes may partly contain a vinyl bound chain (C—C) as blocks or grafts in their molecule.

The polar waxes described above are incorporation in the heat-fusible colorless layer in amounts that usually range from 5 to 100 wt %, preferably from 5 to 50 wt %.

The heat-fusible colorless layer can be formed by various coating methods such as hot-melt coating, aqueous coating and a coating method that employs an organic solvent.

The heat-fusible colorless layer to be formed on the support by various coating methods as described above has a thickness which preferably ranges from 0.5 to 10 μm, with the range of 1-5 pm being particularly preferred.

The heat-fusible colorless layer may be single-layered, or it may be composed of more than one layer as long as the objects of the present invention are not impaired.

The thermal transfer recording medium of the present invention may have a resin layer between each of the heat-fusible colorant layers and the heat-fusible colorless layer. The optionally provided resin layer prevents the polyoxyethylene compound in the heat-fusible colorless layer to diffuse into the adjacent heat-fusible colorant layer, to thereby prevent separation from occurring in that heat-fusible colorant layer on account of cohesive failure. Therefore, if a heat-fusible colorant layer adjacent to the heat-fusible colorless layer contains a material that is highly miscible with or has high affinity for the polyoxyethylene compound, it is particularly effective to provide a resin layer between the heat-fusible colorless layer and the heat-fusible colorant layer adjacent thereto.

The resin layer described above contains a thermoplastic resin as a basic ingredient. Those thermoplastic resins which can be employed in the heat-fusible colorant layer may be used with advantage.

The thermoplastic resin is contained in the resin layer in an amount that usually ranges from 40 to 100 wt %, preferably from 60 to 100 wt %.

Besides the thermoplastic resin, the resin layer can contain other materials such as the heat-fusible materials, colorants, inorganic or organic fine particles, oils, etc. that are already described hereinabove.

The resin layer can be formed on the heat-fusible colorant layers by various coating methods such as hot-melt coating, aqueous coating, and a coating method that employs an organic solvent.

The resin layer preferably has a thickness in the range of from 0.1 to 5 μm.

The thermal transfer recording medium of the present invention can be so designed that the heat-fusible colorless layer has a higher melt viscosity than any of the heat-fusible colorant layers between which said colorless layer is held. When printing is done on a receiving sheet using this thermal transfer recording medium, satisfactory scuff-free separation can be realized at the interface between the heat-fusible colorless layer and the adjacent heat-fusible colorant layer which is to be transferred onto the receiving sheet, to thereby insure that said heat-fusible colorant layer is easily transferred to the latter. At the same time, the heat-fusible colorless layer and the heat-fusible colorant layer that are to be transferred in the next impression can be prevented from being transferred onto the receiving sheet in the first impression.

Any method can be employed to render the heat-fusible colorless layer to have a higher melt viscosity than any of the adjacent heat-fusible colorant layers as long as the objects of the present invention will not be impaired. Several examples of the applicable methods are described below: (1) a heat-fusible material is selected that has a higher melt viscosity than any of the heat-fusible materials used in the heat-fusible colorant layers and the heat-fusible colorless layer is formed of this heat-fusible material; (2) if the heat-fusible colorant layers do not contain a thermoplastic resin, a heat-fusible material is used in combination with one of the thermoplastic resin described above to make the heat-fusible colorless layer;

(3) if the heat-fusible colorant layers contain one of the thermoplastic resins described above, a thermoplastic resin having a higher melt viscosity than said thermoplastic resin and it is used in combination with a heat-fusible material to make the heat-fusible colorless layer; (4) a heat-fusible material is combined with a thermoplastic resin in a greater amount than any of the above-described thermoplastic resins used in the heat-fusible colorant layers, to thereby make the heat-fusible colorless layer; and (5) a filler is used in addition to the heat-fusible material and the thermoplastic resin described above, to thereby make the heat-fusible colorless layer.

Exemplary fillers that can be used in method (5) include silicon oxide, titanium oxide, aluminum oxide, calcium carbonate, zinc sulfate, tin oxide, chromium oxide, silicon carbide, calcium carbonate, talc, kaolin, boron nitride, zinc fluoride, molybdenum dioxide, etc. In any event, any fillers can be used without particular limitation as long as they allow the heat-fusible colorless layer to have a higher melt viscosity than the heat-fusible colorant layers.

The exact amounts in which the ingredients of the heat-fusible colorless layer should be used cannot generally be specified since they depend on which method is employed to render said colorless layer to have a higher melt viscosity than the heat-fusible colorant layers. In case of a heat-fusible colorless layer that is composed of a heat-fusible material, a thermoplastic resin and a filler, the content of the heat-fusible material is generally within the range of 5-90 wt %, preferably 10-80 wt %, the content of the thermoplastic resin being generally within the range of 5-90 wt %, preferably 10-50 wt %, and the content of the filler being generally within the range of 3-40 wt %, preferably 5-30 wt %.

The exact value of the melt viscosity of the heat-fusible colorless layer having the formulation described above cannot generally be specified since it depends on the type of heat-fusible material used or on the content of the thermoplastic resin or filler if they are to be used. As a guide, the heat-fusible colorless layer has a melt viscosity of 300-10,000 cPs, preferably 500-5,000 cPs, at 100° C.

The exact value of the melt viscosity of the heat-fusible colorant layer also cannot generally be specified since it depends on the type of heat-fusible material used or on the content of the thermoplastic resin or additive if they are to be used. As a guide, the heat-fusible colorant layer has a melt viscosity of 20-1,000 cPs, preferably 50-500 cPs, at 100° C.

The ratio of the melt viscosity of the heat-fusible colorless layer to that of the heat-fusible colorant layer is generally within the range of from 1.5 to 200, preferably from 2 to 50.

If recurring units each composed of a heat-fusible colorant layer and a heat-fusible colorless layer are to be provided on the support, it is preferred that a heat-fusible colorant layer that is situated the closer to the support has the higher melt viscosity because this insures that the outermost heat-fusible colorant layer will be separated first, then comes off the next top heat-fusible colorant layer.

For the purposes of the present invention, the thermal transfer recording medium need only comprise the support which has at least two heat-fusible colorant layers and a heat-fusible colorless layer held between these colorant layers. If desired, recurring units composed of a heat-fusible colorless layer and a heat-fusible colorant layer in the order written may be formed in superposition on that side of the assembly of two heat-fusible colorant layers and a heat-fusible colorless layer which is remote from said colorless layer.

The number of heat-fusible colorant and colorless layers to be formed on the support is in no way limited and may be determined appropriately in consideration of the number of impressions that are desirably performed with the thermal transfer recording medium of the present invention.

In another preferred embodiment, the thermal transfer recording medium of the present invention may be so designed that heat-fusible colorant and colorless layers are placed alternately, with the topmost layer being a heat-fusible colorless layer. As shown in FIG. 1, a first heat-fusible colorant layer **12*b* is transferred in the first impression to produce a deficient area 14 but since the asperities 15 at the edge of this area are covered with the topmost heat-fusible colorless layer 13*b***, no ghost will occur in the second impression. This is also the case in subsequent impressions since the asperities around the cavity formed by printing operations are covered with the topmost heat-fusible colorless layer and associated heat-fusible colorless layers.

The cohesive force of the topmost heat-fusible colorless layer is not limited to any particular value.

The thermal transfer recording medium of the present invention can be fabricated by a process which comprises coating the support with a heat-fusible colorant layer, a heat-fusible colorless layer and another heat-fusible colorant layer in the order written, optionally drying and smoothing the surface of the applied layers, and finally cutting the web to a desired shape and size. The thus fabricated thermal transfer recording medium can be used either as a broad tape which is generally applied to line printers or as a ribbon for typewriters.

Thermal transfer can be accomplished with the thermal transfer recording medium of the present invention by any ordinary method of thermal transfer recording. The following explanation assumes the case where a thermal head for line printers that has a linear array of heating elements is used as a heat source. First, the heat-fusible colorant layers in the recording medium are brought into intimate contact with a receiving sheet such as plain paper and, with the back side of the receiving sheet being optionally pressed with a platen, heat pulses are applied with the thermal head to locally heat the recording medium in areas that correspond to the desired printing or transfer pattern. The temperature of the superposed heat-fusible layers increases in the heated areas, causing the heat-fusible colorant layers and heat-fusible colorless layer to soften quickly, whereupon cohesive failure occurs in the heat-fusible colorless layer having the smaller cohesive force or interfacial failure takes place at the interface between said colorless layer and an adjacent heat-fusible colorant layer to permit the necessary heat-fusible colorant layer to be separated and transferred onto the receiving sheet. In the second and subsequent impressions, that area of the topmost heat-fusible colorant layer or the second top heat-fusible colorant layer which corresponds to the heated area will be transferred onto the receiving sheet.

Several examples of the present invention are described below with reference to FIGS. 2-14.

EXAMPLE 1

Figure 2:
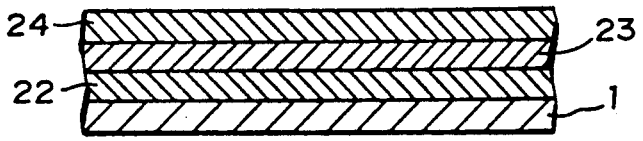

As shown in FIG. 2, a polyethylene terephthalate film (6 μm thick) serving as a support 1 was successively coated with a first heat-fusible colorant layer 22 (3 μm thick), a heat-fusible colorless layer 23 (1.5 μm thick) and a second heat-fusible colorant layer 24 (3 μm thick) to prepare a thermal transfer recording medium. The first heat-fusible colorant layer 22 and the second heat-fusible colorant layer 24 were formed by a hot-melt coating method whereas the heat-fusible colorless layer 23 was formed by a solvent coating method.

The formulas of the respective layers are shown below.

| | |
|---|---|
| First heat-fusible colorant layer 22 | |
| Carbon black | 15 (parts by weight) |
| Paraffin wax (HNP-10 of Nippon Seiro Co., Ltd.) | 50 |
| Carnauba wax | 20 |
| Ethylene/vinyl acetate copolymer (NUC-3150 of Nippon Unicar Co., Ltd.) | 15 |
| Heat-fusible colorless layer 23 | |
| Paraffin wax (HNP-10 of Nippon Seiro Co., Ltd.) | 70 |
| Polyethylene glycol (Mw = 4,000) | 30 |
| Second heat-fusible colorant layer 24 | |
| Carbon black | 15 |
| Paraffin wax (HNP-10 of Nippon Seiro Co., Ltd.) | 55 |
| Carnauba wax | 20 |
| Ethylene/vinyl acetate copolymer (NUC-3150 of Nippon Unicar Co., Ltd.) | 10 |

Using the so fabricated thermal transfer recording medium, two impressions were made on plain paper with a thermal printer (line head 260 mm wide; 180 DPI; hardness of platen rubber, 40 degrees). The image obtained by the second impression was found to have no defect such as ghost or interruption of characters.

EXAMPLE 2

Figure 3:
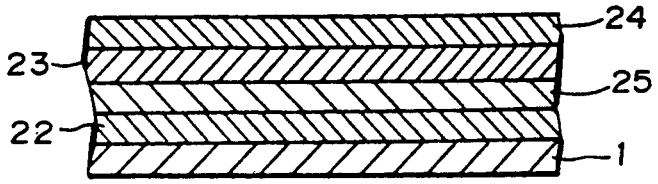

As shown in FIG. 3, a support 1 was successively coated with a first heat-fusible colorant layer 22 (3 μm thick), a resin layer 25 (1 μm thick), a heat-fusible colorless layer 23 (1.5 μm thick) and second heat-fusible colorant layer 24 (3 μm thick) to prepare a thermal transfer recording medium.

The respective layers were formed as in Example 1.

| First heat-fusible colorant layer 22 | |
|---|---|
| Carbon black | 15 (parts by weight) |
| Paraffin wax (HNP-10 of Nippon Seiro Co., Ltd.) | 35 |
| Carnauba wax | 20 |
| Polyoxyethylene distearate (Mw of polyoxyethylene portion = 6,000) | 15 |
| Ethylene/vinyl acetate copolymer (NUC-3150 of Nippon Unicar Co., Ltd.) | 15 |
| Resin layer 25 | |
| Polystyrene resin (SB-75 of Sanyo Chemical Industries, Ltd.) | 50 |
| Ethylene/vinyl acetate copolymer (EV-45 of Mitsui-DuPont Polychemical Co., Ltd.) | 30 |
| Ester wax (Plakcel 220 of Daicel Chemical Industries, Ltd.) | 20 |

HEAT-FUSIBLE COLORLESS LAYER 23

Same as in Example 1.

SECOND HEAT-FUSIBLE COLORANT LAYER 24

Same as in Example 1.

Using the so fabricated thermal transfer recording medium, two impressions were made as in Example 1. The image obtained by the second impression was found to have no defect such as ghost or interruption of characters.

EXAMPLE 3

Figure 4:
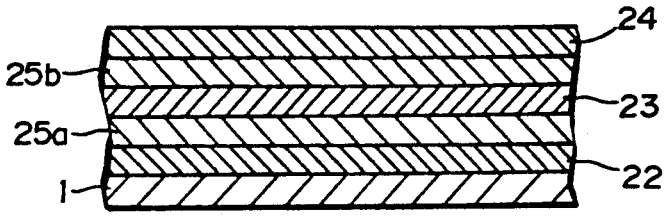

As shown in FIG. 4, a support 1 (6 μm thick) was successively coated with a first heat-fusible colorant layer 22 (2 μm thick), a first resin layer **25*a* (1 μm thick), a heat-fusible colorless layer 23 (1 μm thick), a second resin layer 25*b* (1 μm thick) and a second heat-fusible colorant layer 24** (2 μm thick) to prepare a thermal transfer recording medium.

The respective layers were formed as in Examples 1 and 2. Their formulas are described below.

FIRST HEAT-FUSIBLE COLORANT LAYER 22

Same as in Example 2.

FIRST RESIN LAYER 25*a*

Same as in Example 2.

| Heat-fusible colorless layer 23 | |
|---|---|
| Paraffin was (HNP-10 of Nippon Seiro Co., Ltd.) | 75 (parts by weight) |
| Polyoxyethylene monobehenyl ether | 25 |

-continued

| | |
|---|---|
| (Mw of polyoxyethylene portion = 4,000) | |

SECOND RESIN LAYER 25*b*

Same as in Example 2.

SECOND HEAT-FUSIBLE COLORANT LAYER 24

Same as in Example 1.

Using the thus fabricated thermal transfer recording medium, three impressions were made as in Example 1. The image obtained by the third impression was found to have nod effect such as ghost or interruption of characters.

EXAMPLES 4–6

Additional samples of thermal transfer recording medium were prepared as in Examples 1–3 except that an adhesive layer (1 pm thick) was formed between the support 1 and the first heat-fusible colorant layer 22. The adhesive layer was formed from a coating solution (for its formula, see below) by a wire bar coating method.

| Adhesive layer coating solution | |
|---|---|
| Ethylene/vinyl acetate copolymer (EV 40LX of Mitsui-DuPont Polychemical Co., Ltd.) | 5 (parts by weight) |
| Toluene | 95 |

Using the so fabricated thermal transfer recording media, impressions were made as in Example 1. None of the images obtained with these media were found to have defects such as ghost and interruption of characters.

EXAMPLE 7

Figure 5:
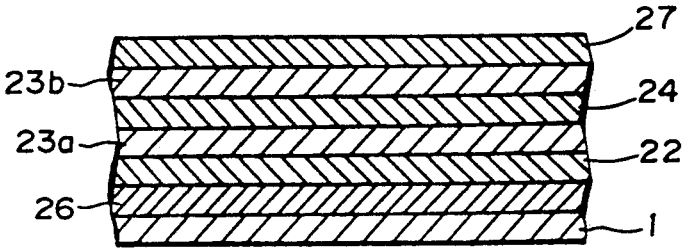
FIGS. 2–12 are cross-sectional sketches of thermal transfer recording media according to various embodiments of the present invention.

As shown in FIG. 5, a support 1 (6 μm thick) was successively coated with an adhesive layer 26 (1 μm thick), a first heat-fusible colorant layer 22 (2 μm thick), a first heat-fusible colorless layer **23*a* (1.5 μm thick), a second heat-fusible colorant layer 24 (2 μm thick), a second heat-fusible colorless layer 23*b* (1.5 μm thick) and a third heat-fusible colorant layer 27** (2 μm thick) to prepare a thermal transfer recording medium.

The respective layers were formed as in the previous examples and their formulas were as follows.

ADHESIVE LAYER 26

Same as in Examples 4–6.

First heat-fusible colorant layer 22

Same as in Example 1.

| First heat-fusible colorless layer 23a | |
|---|---|
| Paraffin wax (HNP-10 of Nippon Seiro Co., Ltd.) | 70 (parts by weight) |
| Polyethylene glycol (Mw = 4,000) | 30 |

SECOND HEAT-FUSIBLE COLORANT LAYER 24

Same as in Example 1.

| Second heat-fusible colorless layer 23b | |
|---|---|
| Paraffin wax (HNP-10 of Nippon Seiro Co., Ltd.) | 85 |
| Polyethylene glycol (Mw = 4,000) | 15 |
| third heat-fusible colorant layer 27 | |
| Carbon black | 15 |
| Paraffin wax (HNP-10 of Nippon Seiro Co., Ltd.) | 60 |
| Carnauba wax | 20 |
| Ethylene/vinyl acetate copolymer (NUC-3150 of Nippon Unicar Co., Ltd.) | 5 |

Using the thus fabricated thermal transfer recording medium, three impressions were made in a thermostatic chamber controlled at 0° C., 25° C. or 45° C. and the print density of each of the images obtained was measured with an optical reflectometer. The results are shown in Table 1, from which it is clear that high print density was attained in a consistent way at each of the test temperatures. Further, all the images obtained were free from ghost and interruption of characters.

EXAMPLE 8

Figure 6:
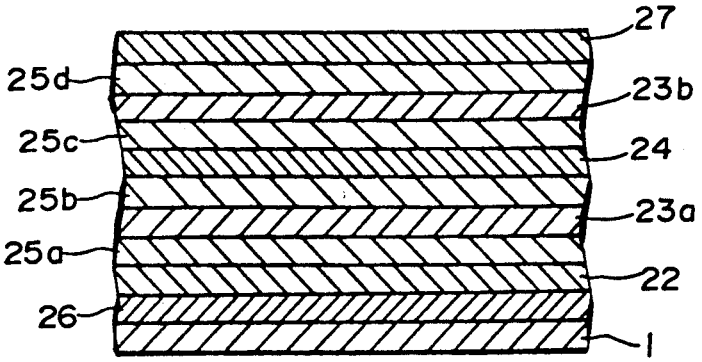

As in FIG. 6, a support 1 (6 μm thick) was successively coated with an adhesive layer 26 (1 μm thick), a first heat-fusible colorant layer 22 (2 μm thick), a first resin layer 25*a* (1 μm thick), a first heat-fusible colorless layer 23*a* (1 μm thick), a second resin layer 25*b* (1 μm thick), a second heat-fusible colorant layer 24 (2 μm thick), a third resin layer 25*c* (1 μm thick), a second heat-fusible colorless layer 23*b* (1 μm thick), a fourth resin layer 25*d* (1 μm thick) and a third heat-fusible colorant layer 27 (2 μm thick) to prepare a thermal transfer recording medium.

The respective layers were formed as in the previous examples, and their formulas were as follows.

ADHESIVE LAYER 26

Same as in Examples 4–6.

First heat-fusible colorant layer 22

Same as in Example 1.

First resin layer 25*a*

Same as resin layer 25 in Example 2.

| First heat-fusible colorless layer 23a | |
|---|---|
| Paraffin wax (HNP-10 of Nippon Seiro Co., Ltd.) | 70 (parts by weight) |
| Polyoxyethylene distearate (Mw of polyoxyethylene portion = 4,000) | 30 |

SECOND RESIN LAYER 25*b*

Same as resin layer 25 in Example 2.

SECOND HEAT-FUSIBLE COLORANT layer 24

Same as in Example 1.

THIRD RESIN LAYER 25*c*

Same as resin layer 25 in Example 2.

| Third heat-fusible colorless layer 23b | |
|---|---|
| Paraffin wax (HNP-10 of Nippon Seiro Co., Ltd.) | 85 |
| Polyoxyethylene distearate (Mw of polyoxyethylene portion = 4,000) | 15 |

FOURTH RESIN LAYER 25*d*

Same as resin layer 25 in Example 2.

THIRD HEAT-FUSIBLE COLORANT LAYER 27

Same as in Example 7.

Using the thus fabricated thermal transfer recording medium, three impressions were made in a thermostatic chamber controlled at 0° C., 25° C. or 45° C. and the print density of each of the images obtained was measured with an optical reflectometer. The results are shown in Table 1, from which one can see that high print density was attained in a consistent way at each of the test temperatures. Further, all the images obtained were free from ghost and interruption of characters.

COMPARATIVE EXAMPLE 1

A polyethylene terephthalate film (6 μm thick) serving as a support was coated with an adhesive layer which was the same as the one used in Examples 4–6. The adhesive layer was overlaid with a heat-fusible colorant layer in a thickness of 8 μm which was the same as the first heat-fusible colorant layer used in Example 2. Using the thus fabricated thermal transfer recording medium, three impressions were made in a thermostatic chamber controlled at 0° C., 25° C., or or 45° C. and the print density of each of the images obtained was measured with an optical reflectometer. The results are shown in Table 1, from which one can see that high print density was attained in a consistent way at 25° C. However, only low-density print was attained at 0° C. and considerable density variations occurred at 45° C.

TABLE 1

| | Temperature, °C. | Optical reflection density | | |
|---|---|---|---|---|
| | | First impression | Second impression | Third impression |
| Example 7 | 0 | 1.15 | 1.20 | 1.17 |
| | 25 | 1.20 | 1.22 | 1.18 |
| | 45 | 1.21 | 1.20 | 1.20 |
| Example 8 | 0 | 1.10 | 1.06 | 1.11 |
| | 25 | 1.15 | 1.19 | 1.10 |
| | 45 | 1.18 | 1.16 | 1.14 |
| Comparative Example 1 | 0 | 0.64 | 0.70 | 0.66 |
| | 25 | 1.20 | 1.18 | 1.10 |
| | 45 | 1.42 | 0.96 | 0.54 |

EXAMPLE 9

Figure 7:
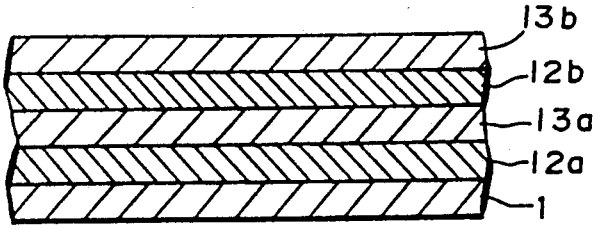

As shown in FIG. 7, a support 1 which was a ployethylene terephthalate film (6 μm thick) was successively coated with a heat-fusible colorant layer 12*a* (3 μm thick), a heat-fusible colorless layer 13*a* (2 μm thick), a heat-fusible colorant layer 12*b* (3 μm thick) and a heat-fusible colorless layer 13*b* (0.5 μm thick) by a hot-melt coating method to fabricate a thermal transfer recording medium.

The formulas of heat-fusible colorant layers 12 and heat-fusible colorless layers 13 are described below.

| Heat-fusible colorant layers 12a and 12b | |
|---|---|
| Carbon black | 15 (parts by weight) |
| Paraffin was (HNP-10 of Nippon Seiro Co., Ltd.) | 60 |

-continued

| | |
|---|---|
| Carnauba wax | 15 |
| Ethylene/vinyl acetate copolymer (NUC-3150 of Nippon Unicar Co., Ltd.) | 10 |
| Heat-fusible colorless layer 13a | |
| Paraffin wax | 60 |
| Polyethylene glycol (Mw = 6,000) | 30 |
| Ethylene/vinyl acetate copolymer (MB-080 of Nippon Unicar Co., Ltd.) | 10 |
| Heat-fusible colorless layer 13b | |
| Paraffin wax | 90 |
| Ethylene/vinyl acetate copolymer (MB-080 of Nippon Unicar Co., Ltd.) | 10 |

Using the so fabricated thermal transfer recording medium two impressions were made as in Example 1. The image obtained by the second impression was found to have no defect such as ghost or interruption of characters.

EXAMPLE 10

Figure 8:
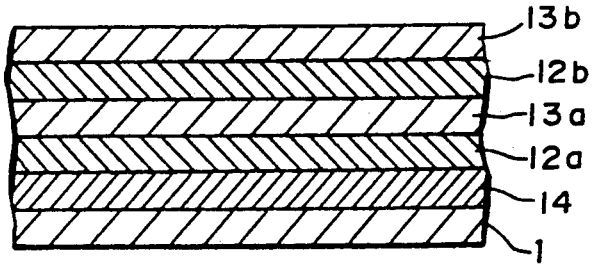

As shown in FIG. 8, a thermal transfer recording medium was fabricated as in Example 9 except that heat-fusible colorant layer 12*a* was formed on the support with an adhesive layer 14 interposed. Using this medium, printing was done as in Example 1.

Adhesive layer 14 was formed by wire-bar coating a solution (for its formula, see below) to give a dry thickness of 1 μm.

| Adhesive layer coating solution | |
|---|---|
| Ethylene/vinyl acetate copolymer (EV 40LX of Mitsui-DuPont Polychemical Co., Ltd.) | 5 (parts by weight) |
| Toluene | 95 |

The image obtained by the second impression was found to have no defect such as ghost or interruption of characters.

EXAMPLE 11

Figure 9:
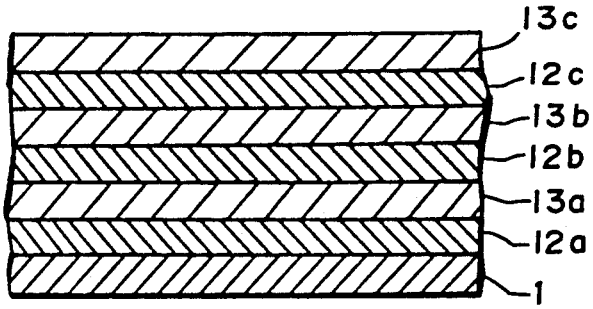

As shown in FIG. 9, a support 1 which was a polyethylene terephthalate film (6 μm thick) was successively coated with a heat-fusible colorant layer 12*a* (2 μm thick), a heat-fusible colorless layer 13*a* (1 μm thick), a heat-fusible colorant layer 12*b* (2 μm thick), a heat-fusible colorless layer 13*b* (1 μm thick), a heat-fusible colorant layer 12*c* (2 μm thick) and a heat-fusible colorless layer 13*c* (0.5 μm thick) to form a thermal transfer recording medium.

The formulas of heat-fusible colorant layers 12 and heat-fusible colorless layers 13 were as follows.

| Heat-fusible colorant layers 12a, 12b and 12c | |
|---|---|
| Carbon black | 15 (parts by weight) |
| Paraffin wax | 55 |
| Carnauba wax | 20 |
| Ethylene/vinyl acetate copolymer (NUC-3150 of Nippon Unicar Co., Ltd.) | 10 |
| Heat-fusible colorless layer 13a | |
| Paraffin wax | 60 |
| Polyester wax (Plakcel 220N of Daicel Chemical Industries, Ltd.) | 30 |
| Ethylene/vinyl acetate copolymer | 10 |
| Heat-fusible colorless layer 13b | |
| Paraffin wax | 75 |
| Polyester wax (Plakcel 220N of Daicel Chemical Industries, Ltd.) | 15 |
| Ethylene/vinyl acetate copolymer | 10 |
| Heat-fusible colorless layer 13c | |
| Paraffin wax | 90 |
| Ethylene/vinyl acetate copolymer | 10 |

Using the so fabricated thermal transfer recording medium, three impressions were made as in Example 1. None of the images obtained were found to have defects such as ghost and interruption of characters.

EXAMPLE 12

Figure 10:
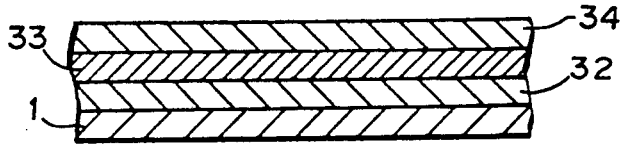

As shown in FIG. 10, a polyethylene terephthalate film (6 μm thick) serving as a support 1 was successively coated with a first heat-fusible colorant layer 32 (3.0 μm thick) and a heat-fusible colorless layer 33 (1.0 μm thick). The first heat-fusible colorant layer 32 was formed by a hot-melt coating method, whereas the heat-fusible colorless layer 33 was formed by a solvent coating method using a dispersion of 20 wt % mixture (for its formula, see below) in toluene.

The formulas and melt viscosities of the first heat-fusible colorant layer 32 and the heat-fusible colorless layer 33 were as follows.

| First heat-fusible colorant layers 32 | |
|---|---|
| Carbon black | 15 (parts by weight) |
| Paraffin wax (HNP-10 of Nippon Seiro Co., Ltd.) | 55 |
| Carnauba wax | 20 |
| Ethylene/vinyl acetate copolymer (NUC-3150 of Nippon Unicar Co., Ltd.) | 10 |
| * melt viscosity, 150 cPs at 100° C. | |
| Heat-fusible colorless layer 33 | |
| Paraffin wax (HNP-10 of Nippon Seiro Co., Ltd.) | 60 |
| Ethylene/vinyl acetate copolymer (NUC-3150 of Nippon Unicar Co., Ltd.) | 20 |
| Calcium carbonate | 20 |
| * melt viscosity, 800 cPs at 100° C. | |

The heat-fusible colorless layer 33 was subsequently overlaid with a second heat-fusible colorant layer 34 (3 μm thick) by a solvent coating method. The formula and melt viscosity of this layer are shown below.

| Second heat-fusible colorant layers 34 | |
|---|---|
| Carbon black | 15 (parts by weight) |
| Paraffin wax (HNP-10 of Nippon Seiro Co., Ltd.) | 60 |
| Carnauba wax | 20 |
| Ethylene/vinyl acetate copolymer (NUC-3150 of Nippon Unicar Co., Ltd.) | 5 |
| * melt viscosity, 90 cPs at 100° C. | |

Using the so fabricated thermal transfer recording medium, two impressions were made as in Example 1. The image obtained by the second impression was found to have no defect such as ghost or interruption of characters.

EXAMPLE 13

Figure 11:
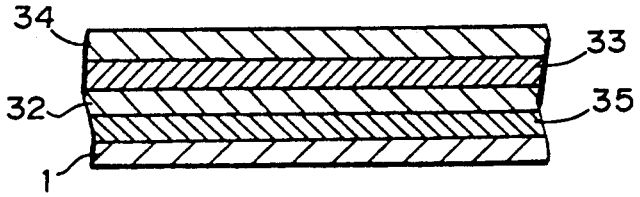

A thermal transfer recording medium was fabricated as in Example 12 except that the first heat-fusible colorant layer 32, heat-fusible colorless layer 33 and the second heat-fusible colorless layer 34 were successively coated on the support 1 with an adhesive layer 35 (1 μthick) being interposed as shown in FIG. 11. The adhesive layer 35 was formed by wire-bar coating a solution having a formula shown below.

| Adhesive layer coating solution | |
|---|---|
| Ethylene/vinyl acetate copolymer (EV 40LX of Mitsui-DuPont Polychemical Co., Ltd.) | 5 (parts by weight) |
| Toluene | 95 |

Using the thus fabricated thermal transfer recording medium, two impressions were made as in Example 1. The image obtained by the second impression was found to have no defect such as ghost or interruption of characters.

EXAMPLE 14

A thermal transfer recording medium was prepared as in Example 13 except that the heat-fusible colorless layer 33 had the formula and melt viscosity indicated below.

| Heat-fusible colorless layer 33 | |
|---|---|
| Paraffin wax (HNP-10 of Nippon Seiro Co., Ltd.) | 70 (parts by weight) |
| Ethylene/ethyl acrylate copolymer (A-709 of Mitsui-DuPont Polychemical Co., Ltd.) | 30 |
| * melt viscosity, 1,500 cPs at 100° C. | |

Using the so fabricated thermal transfer recording medium, two impressions were made as in Example 1. The image obtained by the second impression was found to have no defect such as ghost or interruption of characters.

Example 15

Figure 12:
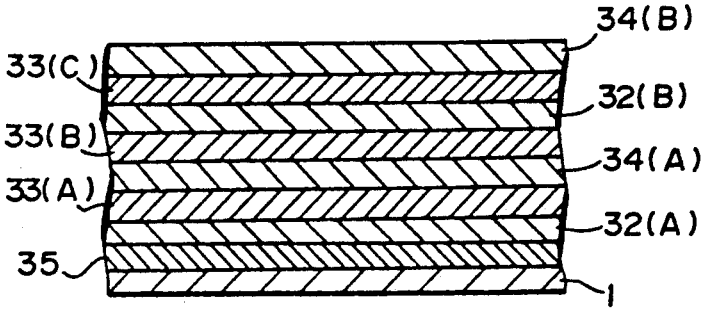

As shown in FIG. 12, a support 1 (6 μm thick) was successively coated with an adhesive layer 35 (the same as the one used in Example 13), a first heat-fusible colorant layer 32(A) (2 μm thick), a first heat-fusible colorless layer 33(A) (0.5 μm thick), a second heat-fusible colorant layer 34(A) (2 μm thick), a second heat-fusible colorless layer 33(B) (0.5 μm thick), a third heat-fusible colorant layer 32(B) (2 μm thick), a third heat-fusible colorless layer 33(C) (0.5 μm thick) and a fourth heat-fusible colorant layer 34(B) (2 μm thick). The adhesive layer 35 was formed by wire bar coating, whereas the other layers were formed by solvent coating. The formulas of the layers other than adhesive layer 35 are shown below.

| First heat-fusible colorant layer 32(A) | |
|---|---|
| Carbon black | 15 (parts by weight) |
| Paraffin wax (HNP-10 of Nippon Seiro Co., Ltd.) | 45 |
| Carnauba wax | 20 |
| Ethylene/vinyl acetate copolymer (NUC-3150 of Nippon Unicar Co., Ltd.) | 20 |
| * melt viscosity, 450 cPs at 100° C. | |
| First heat-fusible colorless layer 33(A) | |
| Paraffin wax (HNP-10 of Nippon Seiro Co., Ltd.) | 60 |
| Ethylene/vinyl acetate copolymer (NUC-3150 of Nippon Unicar Co., Ltd.) | 40 |
| Second heat-fusible colorant layer 34(A) | |
| Carbon black | 15 |
| Paraffin wax (HNP-10 of Nippon Seiro Co., Ltd.) | 50 |
| Carnauba wax | 20 |
| Ethylene/vinyl acetate copolymer (NUC-3150 of Nippon Unicar Co., Ltd.) | 15 |
| * melt viscosity, 300 cPs at 100° C. | |

-continued

| Second heat fusible colorless layer 33(B) | |
|---|---|
| Paraffin wax (HNP-10 of Nippon Seiro Co., Ltd.) | 65 |
| Ethylene/vinyl acetate copolymer (NUC-3150 of Nippon Unicar Co., Ltd.) | 35 |
| * melt viscosity, 1,000 cPs at 100° C. | |
| Third heat-fusible colorant layer 32(B) | |
| Carbon black | 15 |
| Paraffin wax (HNP-10 of Nippon Seiro Co., Ltd.) | 55 |
| Carnauba wax | 20 |
| Ethylene/vinyl acetate copolymer (NUC-3150 of Nippon Unicar Co., Ltd.) | 10 |
| * melt viscosity, 150 cPs at 100° C. | |
| Third heat-fusible colorless layer 33(C) | |
| Paraffin wax (HNP-10 of Nippon Seiro Co., Ltd.) | 70 |
| Ethylene/vinyl acetate copolymer (NUC-3150 of Nippon Unicar Co., Ltd.) | 30 |
| * melt viscosity, 800 cPs at 100° C. | |
| Fourth heat-fusible colorant layer 34(B) | |
| Carbon black | 15 (parts by weight) |
| Paraffin wax (HNP-10 of Nippon Seiro Co., Ltd.) | 60 |
| Carnauba wax | 20 |
| Ethylene/vinyl acetate copolymer (NUC-3150 of Nippon Unicar Co., Ltd.) | 5 |
| * melt viscosity, 90 cPs at 100° C. | |

Figure 13:
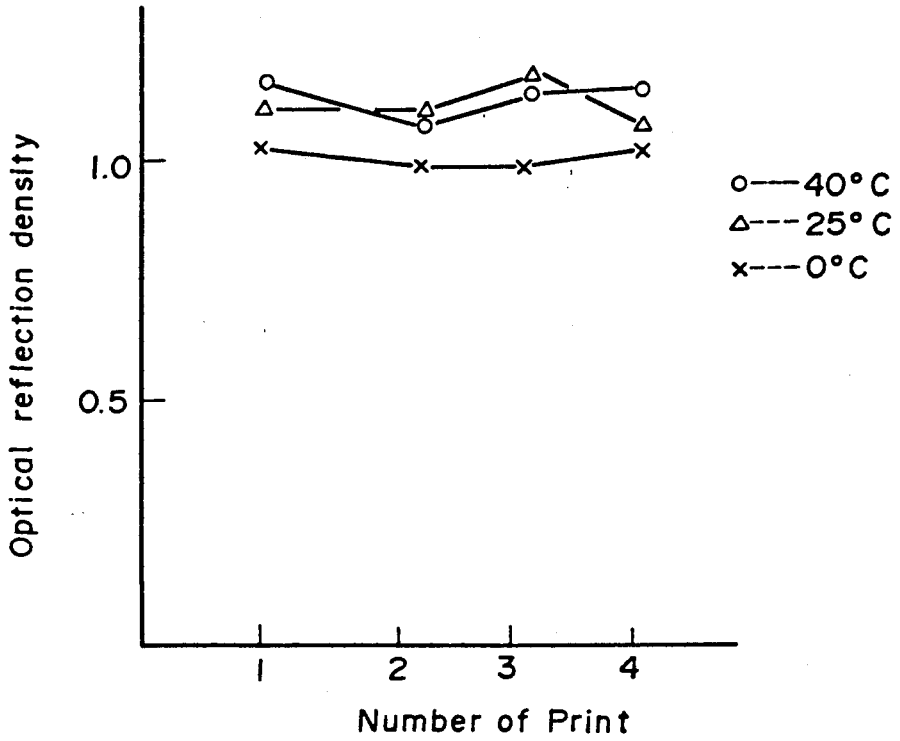
FIG. 13 is a graph showing the relationship between the number of impressions and the density of images formed on the thermal transfer recording medium fabricated in Example 15.

Using the so fabricated thermal transfer recording medium, four impressions were made as in Example 1 in a thermostatic chamber controlled at 0° C., 25° C. or 40° C. The reflection print density of each of the images obtained was measured with an optical reflectometer. The results are shown in FIG. 13, from which one can see that at each of the test temperatures, high-density prints could be obtained in a consistent way without any image defects such as ghost or interruption of characters.

COMPARATIVE EXAMPLE 2

Figure 14:
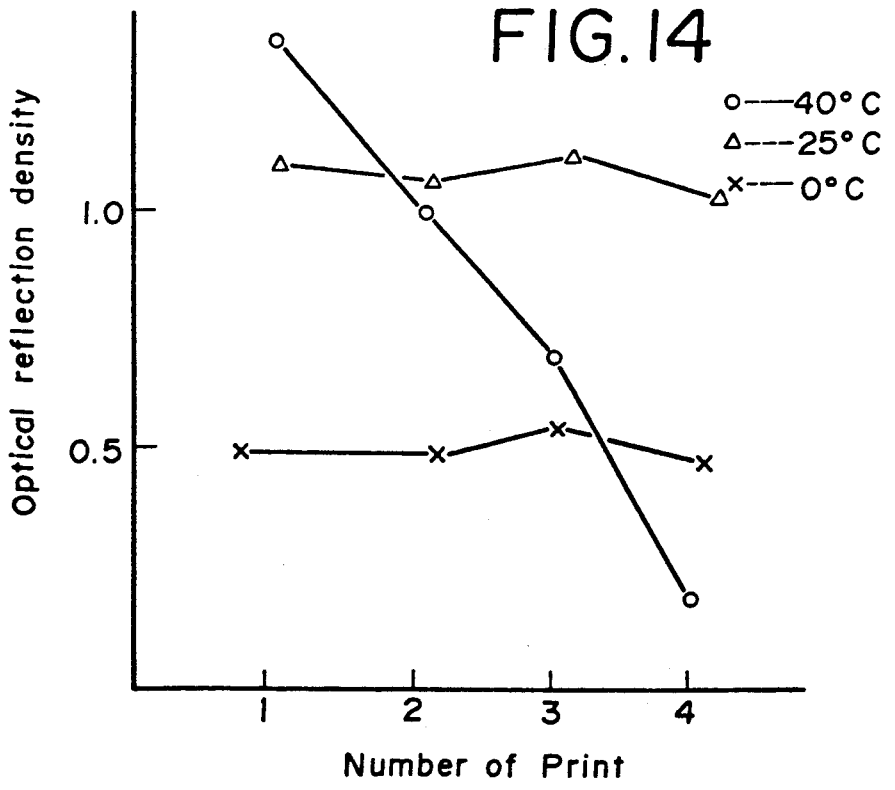
FIG. 14 is a graph showing the relationship between the number of impressions and the density of images formed on the thermal transfer recording medium fabricated in Comparative Example 2.

A thermal transfer recording medium was prepared by coating a support (6 μm thick) with an adhesive layer which was the same as what was used in Example 13 and then with a heat-fusible colorant layer (8 μm thick) which was the same as the one used in Example 12. Using this recording medium, printing was done as in Example 15 and the images obtained were evaluated as in Example 15. The results are shown in FIG. 14, from which one can see that high print density was attained in a consistent way at 25° C. However, considerable density variations occurred at 40° C. and only low-density print could be obtained at 0° C. Further, ghost occurred in the second and subsequent printing cycles at 25° C.

As described on the foregoing pages, the thermal transfer recording medium of the present invention has the following advantages"

(1) it is capable of producing a sharp and ghost-free image through many cycles of printing operation;

(2) it is capable of as many impressions as desired without being influenced by temperature changes; and (3) it yet is capable of producing consistently high print densities without being influenced by temperature changes.

What is claimed is:

1. In a thermal transfer recording medium capable of multiple printing that has at least two heat-fusible colorant layers formed in superposition on a support, the improvement wherein a heat-fusible colorless layer is provided between said heat-fusible colorant layers and wherein said heat-fusible colorless layer contains a polyoxyethylene compound which has in its molecule a portion represented by the following formula:

$-(CH_2CH_2O)_n-$ where n is an integer of at least 2, a wax having at least three ester bonds in its molecule, a wax having at least three amide bonds in its molecule or a wax having at least three urethane bonds in its molecule.

2. A thermal transfer recording medium according to claim 1 wherein said heat-fusible colorless layer has a higher melt viscosity than said heat-fusible colorant layers.

3. A thermal transfer recording medium according to claim 1 wherein said heat-fusible colorant layers and said heat-fusible colorless layer are superposed alternately in such a way that another heat-fusible colorless layer is situated as the topmost layer.

4. A thermal transfer recording medium according to claim 1 wherein a resin layer is provided between each of said heat-fusible colorant layers and said heat-fusible colorless layer.

5. A thermal transfer recording medium according to claim 1 wherein an adhesive layer is provided between said support and one of said heat-fusible colorant layers which is situated the closest to the support.

* * * * *

UNITED STATES PATENT AND TRADEMARK OFFICE

CERTIFICATE OF CORRECTION

PATENT NO. : 5,130,180

DATED : July 14, 1992

INVENTOR(S) : Kunihiro Koshizuka et al.

It is certified that error appears in the above-identified patent and that said Letters Patent is hereby corrected as shown below:

On the title page, before Item [57] in the Attorney, Agent, or Firm, change "Duner" to —Dunner—.

Signed and Sealed this

Twelfth Day of October, 1993

*Attest:*

*Attesting Officer*

Bruce Lehman

BRUCE LEHMAN

*Commissioner of Patents and Trademarks*